US008695580B2

(12) United States Patent
LoRocco

(10) Patent No.: US 8,695,580 B2
(45) Date of Patent: Apr. 15, 2014

(54) ARCHERY BOW STABILIZER ASSEMBLY WITH INTEGRATED WRIST STRAP

(75) Inventor: Paul LoRocco, Dallas, TX (US)

(73) Assignee: TruGlo, Inc., Richardson, TX (US)

( * ) Notice: Subject to any disclaimer, the term of this patent is extended or adjusted under 35 U.S.C. 154(b) by 723 days.

(21) Appl. No.: 12/536,658

(22) Filed: Aug. 6, 2009

(65) Prior Publication Data

US 2010/0031946 A1 Feb. 11, 2010

Related U.S. Application Data

(60) Provisional application No. 61/087,244, filed on Aug. 8, 2008.

(51) Int. Cl.
*F41B 5/20* (2006.01)

(52) U.S. Cl.
USPC ..... 124/89

(58) Field of Classification Search
USPC ..... 124/89, 88, 86, 25.6, 90
See application file for complete search history.

(56) References Cited

U.S. PATENT DOCUMENTS

| | | | | |
|---|---|---|---|---|
| 4,583,513 | A * | 4/1986 | Ellenburg et al. | 124/20.2 |
| 4,714,071 | A | 12/1987 | Saunders | |
| 4,836,177 | A * | 6/1989 | Williams | 124/89 |
| 5,070,856 | A * | 12/1991 | Plummer | 124/88 |
| 5,243,959 | A * | 9/1993 | Savage | 124/88 |
| 5,535,731 | A * | 7/1996 | Webster | 124/89 |
| 5,619,981 | A | 4/1997 | Breedlove | |
| 5,630,407 | A * | 5/1997 | Gasser | 124/89 |
| 7,954,481 | B2 * | 6/2011 | Barnard | 124/88 |

* cited by examiner

*Primary Examiner* — Gene Kim
*Assistant Examiner* — Amir Klayman
(74) *Attorney, Agent, or Firm* — Alvin R. Wirthlin

(57) ABSTRACT

A stabilizer assembly for connection to an archery bow includes an elastomeric body with an integrally formed vibration dampening section and a sling connecting section. The assembly also includes a sling with a loop section for looping around the archery bow and a pair of leg sections extending from the loop section and through a pair of bores formed in the sling connecting section.

21 Claims, 5 Drawing Sheets

ARCHERY BOW STABILIZER ASSEMBLY WITH INTEGRATED WRIST STRAP

RELATED APPLICATIONS

This application claims the benefit of U.S. Provisional Application No. 61/087,244 filed on Aug. 8, 2008, which is hereby incorporated by reference.

BACKGROUND OF THE INVENTION

This invention relates generally to accessories for archery bows, and more particularly to a bow stabilizer assembly having an integrated wrist strap.

Many accessories for archery bows are available for facilitating bow handling, stabilizing the bow during use, improving aiming accuracy, and so on. Once such accessory is in the form of a bow stabilizer which is typically attached to the riser or handle of a bow and extends forwardly therefrom. The stabilizer helps to balance the bow and absorbs shock and vibration during shooting, resulting in a more comfortable grip upon release of an arrow and greater shooting accuracy. The stabilizer is typically a weighted shaft that screws into a threaded bore formed in the riser or handle of the bow.

A bow sling or wrist strap is another accessory that many archers have found useful. The wrist strap typically includes a loop of braided cord that surrounds the riser. A mounting plate is connected to both ends of the cord and typically includes an opening through which a threaded stabilizer shaft extends when connected to the bow. The wrist strap is particularly useful when shooting the bow. In the shooting stance, an archer's hand usually rests against the riser with the fingers in an open position to prevent movement of the bow during aiming. Since the archer does not typically grasp the bow, the bow can be dropped after the arrow is shot, potentially damaging the bow and/or its attached accessories and causing injury.

The simultaneous mounting of the stabilizer and wrist strap can be unwieldy. The installer must first place the mounting plate of the wrist strap at the appropriate location. The stabilizer shaft is then inserted through the mounting plate opening and screwed into the threaded bore of the bow riser. As the stabilizer clamps and rotates against the mounting plate, the mounting plate has a tendency to rotate in the direction of the stabilizer and become tilted. One of the installer's hands must therefore simultaneously hold the bow and the mounting plate in position while the other hand tightens the stabilizer. In addition, when it becomes desirous or expedient to change the wrist strap, the stabilizer must first be removed.

SUMMARY OF THE INVENTION

In accordance with one aspect of the invention, a stabilizer assembly adapted for connection to an archery bow includes a body and a sling. The body has a vibration dampening section and a sling connecting section. The sling connecting section includes at least one bore. The sling has a loop section for looping around the archery bow and a pair of leg sections that extend from the loop section. At least one of the leg sections is adapted to extend at least partially into the at least one bore.

In accordance with a further aspect of the invention, a stabilizer assembly adapted for connection to an archery bow includes an elastomeric body with an integrally formed vibration dampening section and a sling connecting section; and a sling with a loop section for looping around the archery bow and a pair of leg sections extending from the loop section. The leg sections are adapted for connection to the sling connecting section.

It is noted that the drawings are intended to depict only typical embodiments of the invention and therefore should not be considered as limiting the scope thereof. It is further noted that the drawings may not be necessarily to scale. The invention will now be described in greater detail with reference to the accompanying drawings.

DETAILED DESCRIPTION OF THE INVENTION

Figure 1:
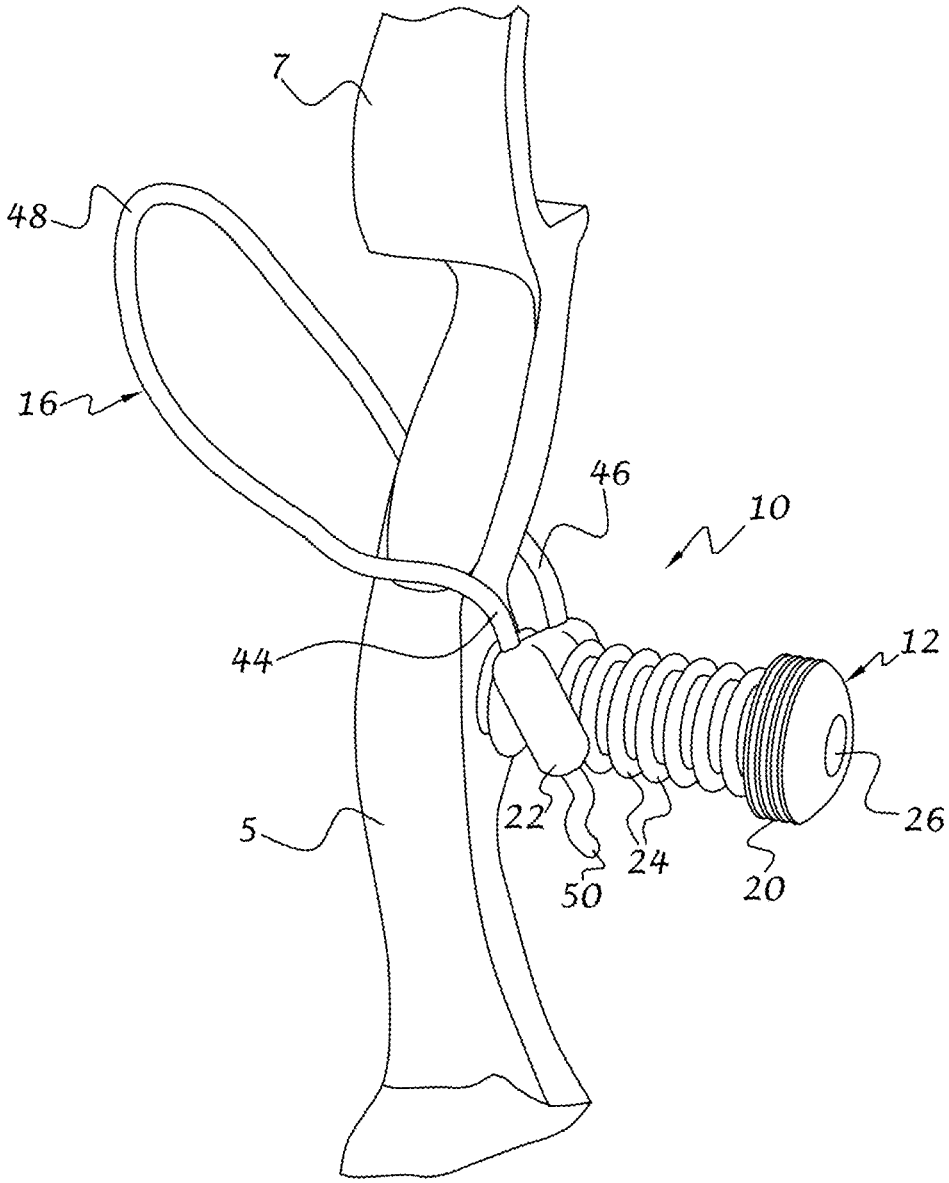
FIG. 1 is a front perspective view of a stabilizer assembly connected to the riser of a bow in accordance with the present invention.
Figure 2:
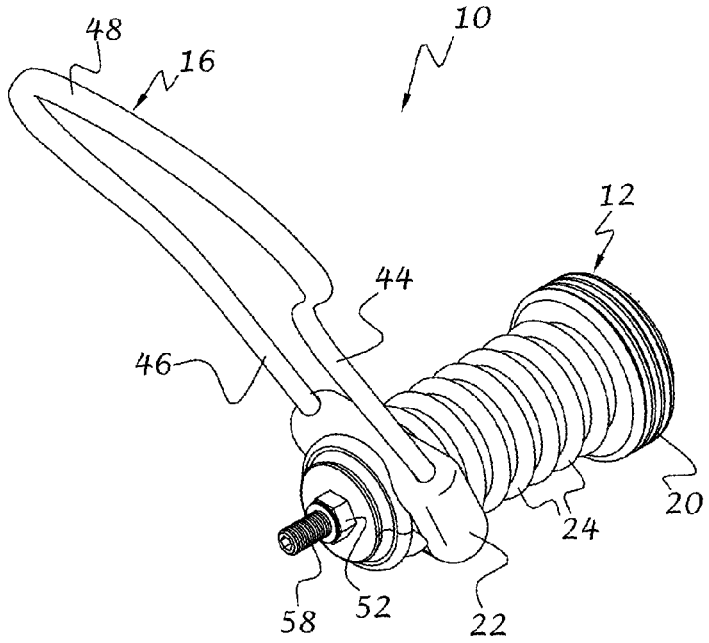
FIG. 2 is a rear isometric view of the stabilizer assembly.
Figure 3:
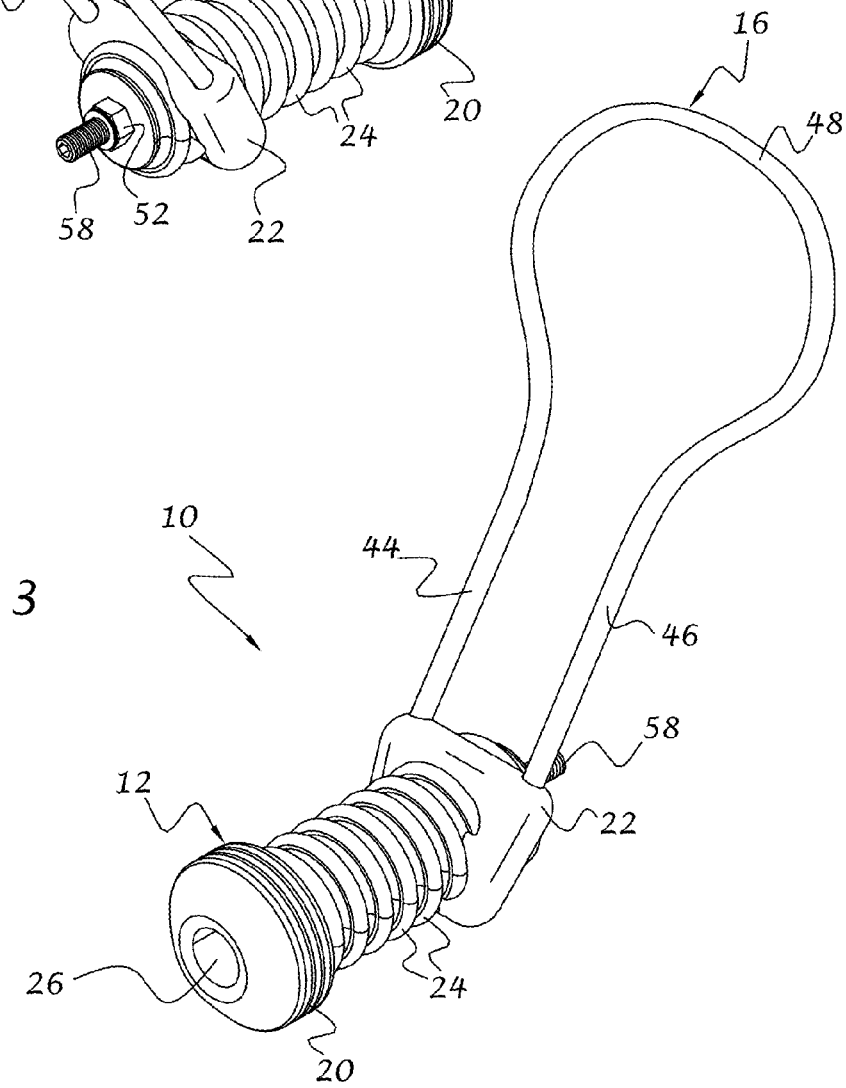
FIG. 3 is a front isometric view thereof.
Figure 4:
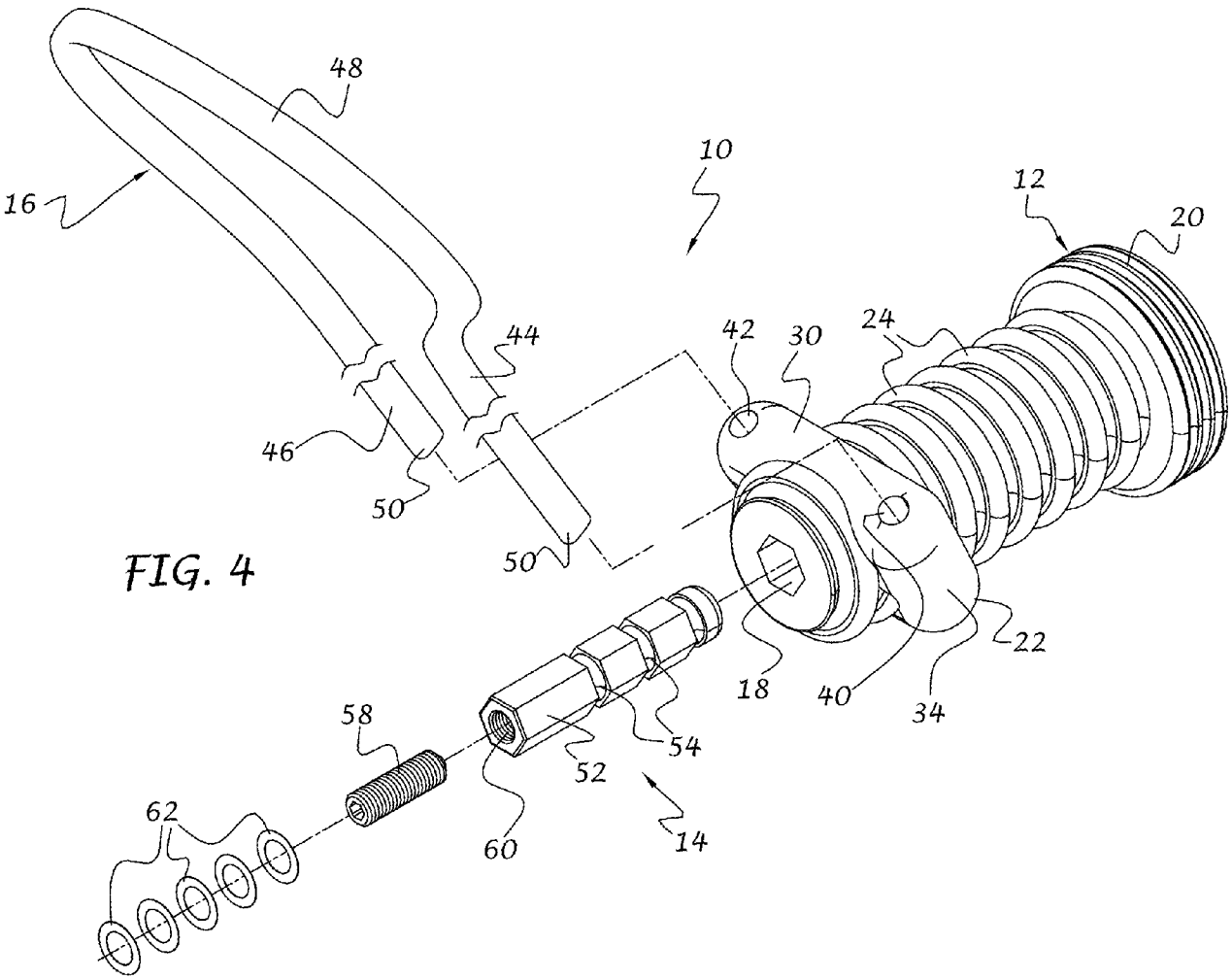
FIG. 4 is an exploded rear isometric view of the stabilizer assembly.
Figure 5:
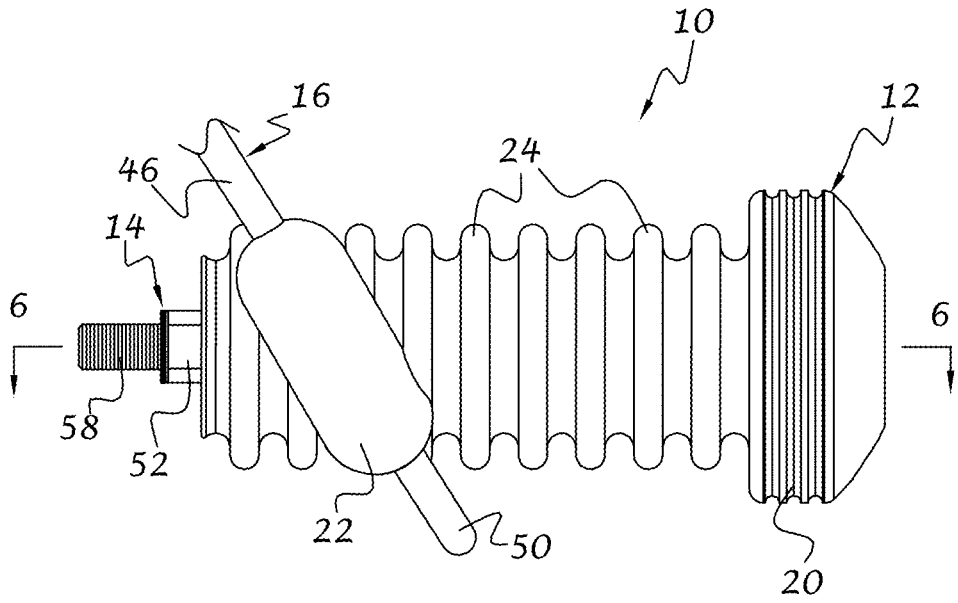
FIG. 5 is a side elevational view thereof.
Figure 6:
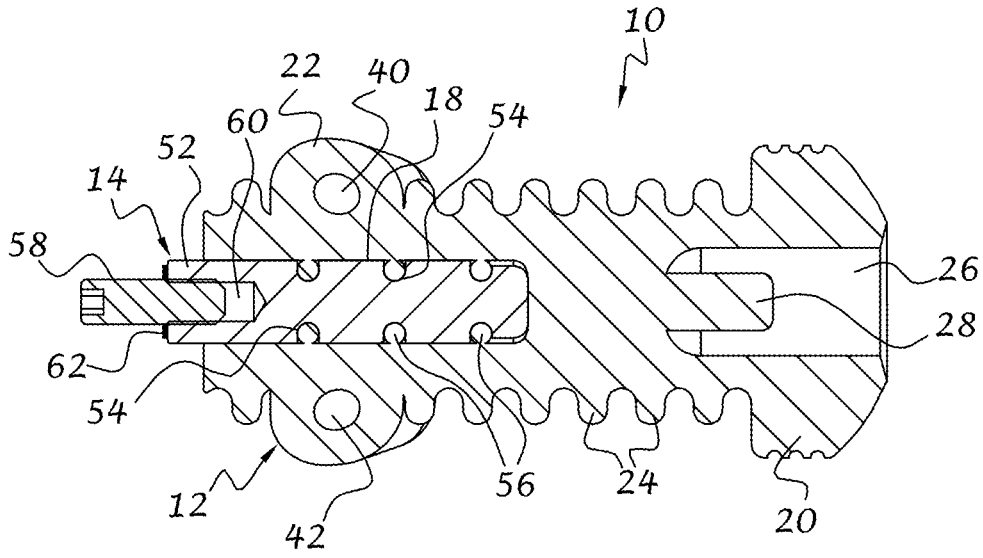
FIG. 6 is a sectional view of the stabilizer assembly taken along line 6-6 of FIG. 5.

Referring now to the drawings, and to FIG. 1 in particular, a stabilizer assembly 10 in accordance with the present invention is illustrated. The stabilizer assembly 10 is adapted for mounting to a threaded aperture (not shown) formed in a riser 5 of an archery bow 7 where a conventional stabilizer would usually be attached. However, it will be understood that the stabilizer assembly 10 can be mounted to the riser or handle or any other convenient location on the archery bow through straps, adhesives, rivets, cooperative locking members, and/or any other connection means. The present invention is primarily adapted for use with compound bows but may also be used with recurve bows, reflex bows, longbows, and so on.

With additional reference to FIGS. 2-6, the stabilizer assembly 10 preferably includes a body 12 with a core 14 located within the body and extending rearwardly therefrom and a wrist strap or sling 16 secured to the body 12. The sling 16 can be constructed of any suitable flexible material including woven and nonwoven fibers, rope, chain, plastic cord or tubing, and so on.

The body 12 preferably includes a central bore 18 for receiving the core 14, a dampening head section 20 located at a forward end of the body 12, and a sling connecting section 22 located at a rearward end of the body.

Figure 7:
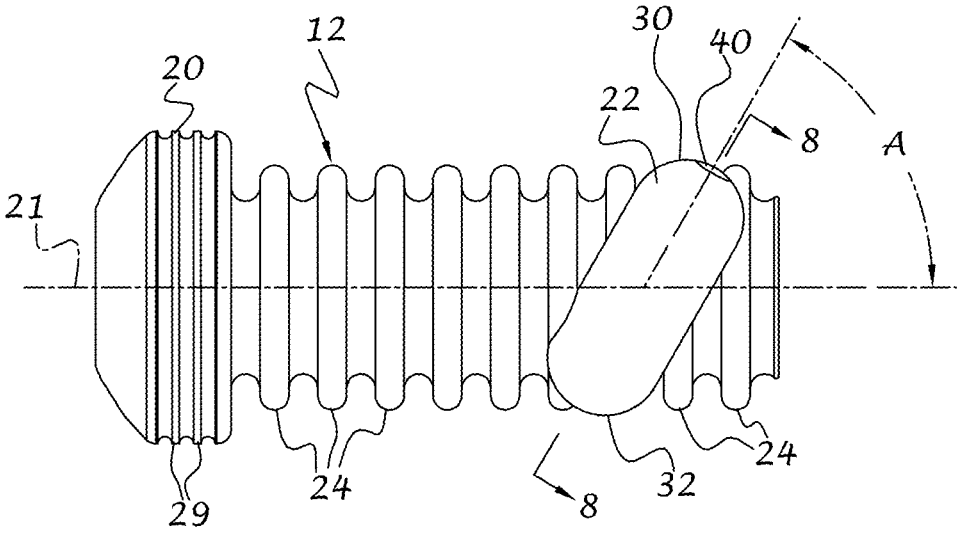
FIG. 7 is a side elevational view of a body that forms part of the stabilizer assembly.

As best shown in FIG. 7, the connecting section 22 preferably extends at a first acute angle A with respect to a centerline 21 of the central bore 18 so that the wrist strap portion 16 extends in a direction that facilitates its use by an archer. A plurality of annular ribs 24 are preferably formed on the body 12. The head section 20 includes a depression 26 and a cantilevered arm 28 located within the depression. The depression 26 and arm 28 form a resonance chamber to substantially reduce or eliminate noise and vibration during use of the archery bow. Annular ribs 29 preferably extend around the outer periphery of the head section 20.

Figure 8:
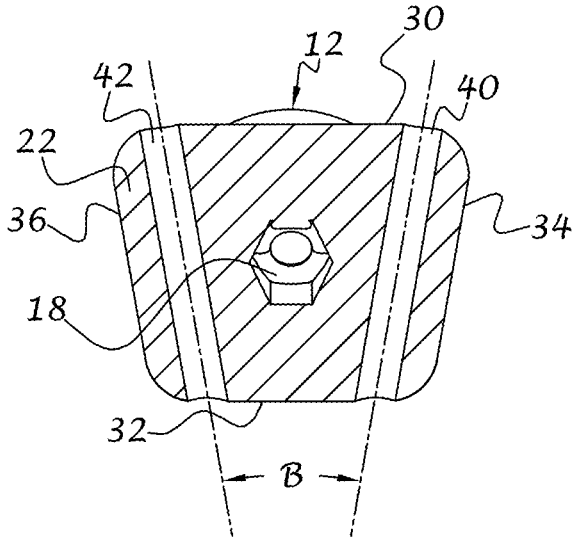
FIG. 8 is a sectional view of the stabilizer body taken along line 8-8 of FIG. 7.

With additional reference to FIG. 8, the sling connecting section 22 is preferably of generally trapezoidal shape. However, it will be understood that the connecting section 22 can be any desired shape. When formed as a trapezoid, the connecting section 22 preferably includes a rounded upper edge 30, a rounded lower edge 32 generally parallel with the upper edge, and rounded side edges 34 and 36 that extend or converge toward each other from the upper edge toward the lower edge at a second acute angle B. A pair of bores 40, 42 extend between the upper edge 30 and lower edge 32 at the angle B so that the side edges 34 and 36 are parallel with the bores 40 and 42, respectively. The bores 40 and 42 are sized to receive leg sections 44 and 46, respectively, of the wrist strap portion 16 to thereby form a loop section 48 that will loop around the wrist or hand of a user during use of the archery bow. During installation, the leg sections 44 and 46 are inserted through their associated bores until the ends 50 of each leg section protrudes from the lower edge 32. The ends 50 may then be secured by friction to the body 12. Depending on the type of material used for the wrist strap portion 15, the ends may be enlarged by tying a knot at each end or tying the ends together, heating the ends, securing a bead or head to the ends, and so on.

Instead of enlarging the ends 50, and in accordance with a further embodiment of the invention, the leg sections 44 and 46 may be bonded within their respective bores through adhesives or well-known over-molding or insert-molding techniques. In this embodiment, the bores 40 and 42 need not extend completely through the connecting section 22.

The body 12 and its associated parts including the head section 20, the strap connecting section 22 and the cantilevered arm 28 is preferably constructed of a single or unitary piece of relatively soft resilient material for providing a noise and vibration dampening effect during use of the archery bow. Suitable materials can include, but are not limited to, elastomers, polyurethanes, open and closed cell foam materials, plastics, and combinations thereof.

The core 14 preferably includes an octagonal-shaped insert 52 with annular grooves 54 that engage annular projections 56 extending radially inwardly into the central bore 18 from the body 12 for securing the core and body together. The octagonal shape of the insert 52 also prevents mutual rotation between the core and body. However, it will be understood that the insert and bore may be of any desired shape. The body 12 and core 14 are preferably secured together during molding of the body 12 through well-known over-molding or insert-molding techniques. However, it will be understood that the body and cores can be connected together through press-fitting, adhesive bonding, and so on. A set screw 58 is threaded into a threaded bore 60 of the insert 52 so that a portion of the screw is exposed to thereby mount the stabilizer assembly 10 to the riser of an archery bow in a conventional manner. Washers 62 can be used for adjusting the rotational orientation of the stabilizer relative to the riser of the archery bow.

In order to install the stabilizer assembly on the archery bow 7, the body 12 with its is aligned with the threaded aperture (not shown) of the bow riser or handle and the appropriate number of washers, if needed, is installed on the set screw 58. The body is then rotated until the set screw 58 of the core 14 is tight within the threaded aperture and the bores 40 and 42 of the sling connecting section 22 extend generally upwardly and inwardly toward the riser 5. One end 50 of one of the leg sections 44 or 46 is then inserted through one of the bores 40, 42 until it protrudes outwardly from the bore, while the other end 50 of the other leg section is looped around the riser then inserted through the other of the bores 40, 42 until it protrudes outwardly from the bore. If desired, the ends 50 may then be modified to prevent them from slipping back through their respective bores 40, 42. Accordingly, installation of the sling to the stabilizer and around the riser can be done without the use of hand tools and is thus greatly facilitated over prior art arrangements.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. By way of example, the body and core can be constructed as a unitary structure during molding, machining or other well-known techniques. In addition, when the body or at least a portion thereof is constructed of relatively stiff material, the core may be eliminated. Moreover, although two bores 40, 42 are associated with the sling connecting section, it will be understood that a single bore can be provided for receiving both ends of the sling 16. In accordance with yet a further embodiment of the invention, one end of the sling can be permanently attached to the body 12 and the other end can be looped around the riser and inserted into a single bore then secured as previously described. It will be understood, therefore, that the present invention is not limited to the particular embodiments disclosed, but also covers modifications within the spirit and scope of the invention as defined by the appended claims.

What is claimed is:

1. A stabilizer assembly adapted for connection to an archery bow, the stabilizer assembly comprising:

a resilient body having an integrally formed sling connecting section and an elongate vibration dampening section extending forwardly from the sling connecting section;

a central bore extending through the sling connecting section and into the elongate vibration dampening section;

a rigid core extending through the central bore and being coincident with the elongate vibration dampening section and the sling connection section to thereby reinforce the resilient body, the rigid core exiting the central bore and extending rearwardly of the resilient body where it terminates in a connecting section for mounting to an archery bow;

the sling connecting section including a first sling connecting bore and a second sling connecting bore extending into the sling connecting section; and a sling including a flexible material with a flexible loop section for looping around the archery bow, a first flexible leg section extending from one side of the loop section, and a second flexible leg section extending from the other side of the loop section, the first and second flexible leg sections extending directly into the first and second bores, respectively.

2. A stabilizer assembly according to claim 1, wherein the first and second leg sections of the sling extend at least partially into the first and second bores, respectively.

3. A stabilizer assembly according to claim 1, wherein first and second bores of the sling connecting section extend at a first acute angle with respect to a centerline of the resilient body to thereby position the loop section at a convenient position for a user when the stabilizer assembly is connected to an archery bow.

4. A stabilizer assembly according to claim 3, wherein the bores converge toward each other at a second acute angle which is oriented transverse to the first acute angle such that the first and second legs diverge away from each other towards the loop portion.

5. A stabilizer assembly according to claim 4, wherein the vibration dampening section is generally cylindrical and the sling connecting section is generally trapezoidal in shape with the first and second bores located adjacent to and oriented parallel with first and second side edges, respectively, of the trapezoidal shaped sling connecting section.

6. A stabilizer assembly according to claim 1, wherein the bores converge toward each other at an acute angle with the first and second bores located adjacent to and oriented parallel with first and second side edges, respectively, of the sling connecting section.

7. A stabilizer assembly according to claim 1, wherein the vibration dampening section is generally cylindrical and the sling connecting section is generally trapezoidal in shape with the first and second bores located adjacent to and oriented parallel with first and second side edges, respectively, of the sling connecting section.

8. A stabilizer assembly according to claim 1, wherein the resilient body, including the vibration dampening section and sling connecting section, is formed of a of a single piece of resilient material for providing a noise and vibration dampening effect during use of the archery bow.

9. A stabilizer assembly according to claim 1 wherein the first and second bores extend completely through the sling connecting section and the first and second leg sections extend completely through the first and second bores, respectively.

10. A stabilizer assembly adapted for connection to an archery bow, the stabilizer assembly comprising:

a resilient body having an integrally formed vibration dampening section and a sling connecting section positioned at a rearward end of the vibration dampening section, the vibration dampening section and the sling connecting section being constructed of a single piece of resilient material for providing a noise and vibration dampening effect during use of the archery bow;

a central bore extending through the sling connecting section and into the elongate vibration dampening section;

a rigid core extending through the central bore and being coincident with the elongate vibration dampening section and the sling connection section to thereby reinforce the resilient body, the rigid core exiting the central bore and extending rearwardly of the resilient body where it terminates in a connecting section for mounting to an archery bow;

and a sling comprising a flexible loop section for looping around the archery bow and a pair of flexible leg sections extending from the loop section, the loop and leg sections being constructed of a single piece of flexible material; the flexible leg sections extending directly into the resilient sling connecting section.

11. A stabilizer assembly according to claim 10, wherein at least one of the flexible leg sections is slidably connected to the resilient sling connecting section.

12. A stabilizer assembly according to claim 10, wherein the sling connecting section comprises an upper edge, a lower edge, and first and second side edges extending between the upper and lower edges, and a first bore and a second bore extending into the sling connecting section between the upper and lower edges, the flexible leg sections of the sling being slidable through the bores.

13. A stabilizer assembly according to claim 12, wherein the side edges of the sling connecting section extend at a first acute angle with respect to a centerline of the body to thereby position the loop section at a convenient position for a user when the stabilizer assembly is connected to an archery bow.

14. A stabilizer assembly according to claim 13, wherein the first and second side edges are oriented at a second acute angle and the bores extend parallel with the first and second side edges, respectively, to thereby converge toward each other at the second acute angle such that the first and second leg sections diverge away from each other towards the loop section.

15. A stabilizer assembly according to claim 12, wherein the first and second side edges are oriented at an acute angle and the bores extend parallel with the first and second side edges, respectively, to thereby converge toward each other at the acute angle such that the first and second leg sections diverge away from each other towards the loop section.

16. A stabilizer assembly according to claim 10, wherein the vibration dampening section is generally cylindrical in shape and the sling connecting section is generally trapezoidal in shape and extends at an acute angle with respect to a centerline of the vibration dampening section.

17. A stabilizer assembly according to claim 10, wherein at least one of the leg sections extends at least partially into the resilient sling connecting section.

18. A stabilizer assembly according to claim 10, wherein the sling connecting section comprises at least one bore, at least one of the flexible leg sections of the sling being adapted to slide through the at least one bore.

19. A stabilizer assembly according to claim 10, wherein the core includes a threaded section for engaging a threaded aperture of an archery bow.

20. A stabilizer assembly for connection to an archery bow, the stabilizer assembly comprising:

a body constructed of a resilient material with elastomeric-like properties and having an integrally formed resilient sling connecting section and a resilient vibration dampening section extending forwardly therefrom to form a single component, with the vibration dampening section being generally cylindrical and the sling connecting section being generally trapezoidal in shape and oriented at a first acute angle with respect to a centerline of the vibration dampening section;

the resilient sling connecting section having:

an upper edge;

a lower edge parallel with the upper edge;

first and second side edges extending between the upper and lower edges at a second acute angle transverse to the first acute angle to thereby form the generally trapezoidal shape; and a first sling connecting bore and a second sling connecting bore extending into the sling connecting section between the upper and lower edges and parallel with the first and second side edges, respectively;

a core over-molded by or insert-molded within the resilient body such that the core is securely located within the resilient body and is coincident with and extending through the resilient sling connection section and is coincident with the vibration dampening section; the core having a rear section that terminates in a threaded section for engaging a threaded aperture of an archery bow; and a sling constructed of a flexible material and having a flexible loop section for looping around the archery bow and a pair of unitary flexible leg sections extending from the loop section, the flexible leg sections extending directly into the bores of the resilient sling connecting section, with at least one of the flexible leg sections of the sling being slidable through at least one of the bores.

21. A stabilizer assembly according to claim 1, wherein the core has at least one of an annular groove and an annular projection in engagement with at least the other of the annular groove and annular projection located in the central bore of the resilient body to thereby secure the core within the resilient body.

* * * * *